US010364656B2

(12) United States Patent
Greci

(10) Patent No.: US 10,364,656 B2
(45) Date of Patent: Jul. 30, 2019

(54) ANNULAR FLOW RINGS FOR SAND CONTROL SCREEN ASSEMBLIES

(71) Applicant: Halliburton Energy Services, Inc., Houston, TX (US)

(72) Inventor: Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 83 days.

(21) Appl. No.: 15/541,361

(22) PCT Filed: Sep. 14, 2016

(86) PCT No.: PCT/US2016/051625

§ 371 (c)(1),
(2) Date: Jun. 30, 2017

(87) PCT Pub. No.: WO2018/052405

PCT Pub. Date: Mar. 22, 2018

(65) Prior Publication Data

US 2018/0266218 A1 Sep. 20, 2018

(51) Int. Cl.

| | |
|---|---|
| ***E21B 43/08*** | (2006.01) |
| ***E21B 43/10*** | (2006.01) |
| ***E21B 34/08*** | (2006.01) |

(52) U.S. Cl.

CPC ..... *E21B 43/08* (2013.01); *E21B 34/08* (2013.01); *E21B 43/086* (2013.01); *E21B 43/10* (2013.01)

(58) Field of Classification Search

CPC ..... E21B 43/08; E21B 43/086
See application file for complete search history.

(56) References Cited

U.S. PATENT DOCUMENTS

| | | | | |
|---|---|---|---|---|
| 7,350,584 | B2 | 4/2008 | Simpson et al. | |
| 2007/0119590 | A1 | 5/2007 | Michel | |
| 2012/0048536 | A1 | 3/2012 | Holderman et al. | |
| 2014/0262260 | A1 | 9/2014 | Mayer et al. | |
| 2014/0262322 | A1 | 9/2014 | Yeh et al. | |
| 2015/0375144 | A1 * | 12/2015 | Greci | E21B 43/08 29/896.61 |

FOREIGN PATENT DOCUMENTS

| | | | | |
|---|---|---|---|---|
| WO | 2009/048846 | A1 | 4/2009 | |
| WO | WO-2014137332 | A1 * | 9/2014 | E21B 43/08 |

OTHER PUBLICATIONS

International Search Report and Written Opinion for PCT/US2016/051625 dated Jun. 15, 2017.

* cited by examiner

*Primary Examiner* — Giovanna C Wright
(74) *Attorney, Agent, or Firm* — McGuireWoods LLP

(57) ABSTRACT

A sand control screen assembly includes a base pipe and a sand screen positioned about an outer surface of the base pipe. An annular flow ring is positioned about the outer surface of the base pipe and is operatively coupled to the sand screen. The annular flow ring includes a cylindrical outer sleeve, a cylindrical inner sleeve received within and coupled to the outer sleeve, and a plurality of radial projections extending radially inward from the inner sleeve to radially support the annular flow ring against the outer surface of the base pipe. A flow annulus is defined between the outer surface of the base pipe and the annular flow ring and the sand screen, and the plurality of radial projections extends into the flow annulus.

17 Claims, 5 Drawing Sheets

ANNULAR FLOW RINGS FOR SAND CONTROL SCREEN ASSEMBLIES

During hydrocarbon production from subterranean formations, efficient control of the movement of unconsolidated formation particles into a wellbore, such as sand or other debris, has always been a pressing concern. Such formation particle movement commonly occurs during production from wellbore completions located in loose sandstone or following the hydraulic fracture of a subterranean formation. Formation particle movement can also occur suddenly in the event a section of the wellbore collapses, whereby significant amounts of particulates and fines circulate within the wellbore. Production of these unwanted materials may cause numerous problems in the efficient extraction of oil and gas from subterranean formations. For example, producing formation particles can plug the formation, production tubing, and various subsurface flow lines. Producing formation particles may also result in the erosion of casing, downhole equipment, and surface equipment. These problems lead to high maintenance costs and unacceptable well downtime.

Sand control screen assemblies, for instance, are often used to regulate and restrict the influx of formation particles. Typical sand control screen assemblies are constructed by installing one or more sand screens about a base pipe. The sand screens filter particulate matter out of the production fluid stream originating from a surrounding subterranean formation such that particulates and other fines are prevented from entering the base pipe.

One type of sand control screen assembly is commonly referred to as a modular screen assembly, which includes one or more sand screens disposed about a base pipe such that an annular flow annulus is defined between the sand screens and the outer surface of the base pipe. Production fluid flows radially through the sand screens and then axially along the exterior of the base pipe within the flow annulus until locating a flow port defined in the base pipe that allows the production fluid to enter the interior of the base pipe. Modular screen assemblies often include one or more outer annular flow rings or completion shrouds disposed about the base pipe to operatively couple axially adjacent sand screens and thereby extend the axial length of the annular flow path. The annular flow rings are required to have high collapse and burst ratings to resist extreme downhole pressures, but must also be thin enough to not overly restrict the flow annulus during operation.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure generally relates to downhole fluid flow control and, more particularly, to high collapse rating annular flow rings used in modular screen assemblies.

The embodiments described herein provide a space efficient, low cost, large diameter tubular or pipe that exhibits a high collapse rating as compared to the thickness of its wall. One concern when designing large diameter parts is elastic collapse failure mode, which occurs when the diameter (D) to thickness (t) ratio (D/t) is approximately 25 or higher. In elastic collapse failure modes, increasing the yield strength of the material does not increase the collapse resistance, but can benefit the burst rating. The low collapse resistance due to elastic collapse is commonly resolved by increasing the wall thickness, which, in turn, reduces the D/t ratio. The embodiments discussed herein allow a tube or pipe to be manufactured with readily available high yield materials, but with thin walls that exhibit high collapse ratings. To accomplish this, the tube or pipe (herein referred to as an "annular flow ring") may be made of a cylindrical outer sleeve and a cylindrical inner sleeve received within and coupled to the outer sleeve. A plurality of radial projections extends radially inward from the inner sleeve to radially support the annular flow ring against the outer surface of an underlying base pipe, which can exhibit a larger wall thickness. The principles discussed herein are most effective on thin-walled, large outer diameter cylindrical parts or components and are applicable to any type of tubular or pipe.

Figure 1:
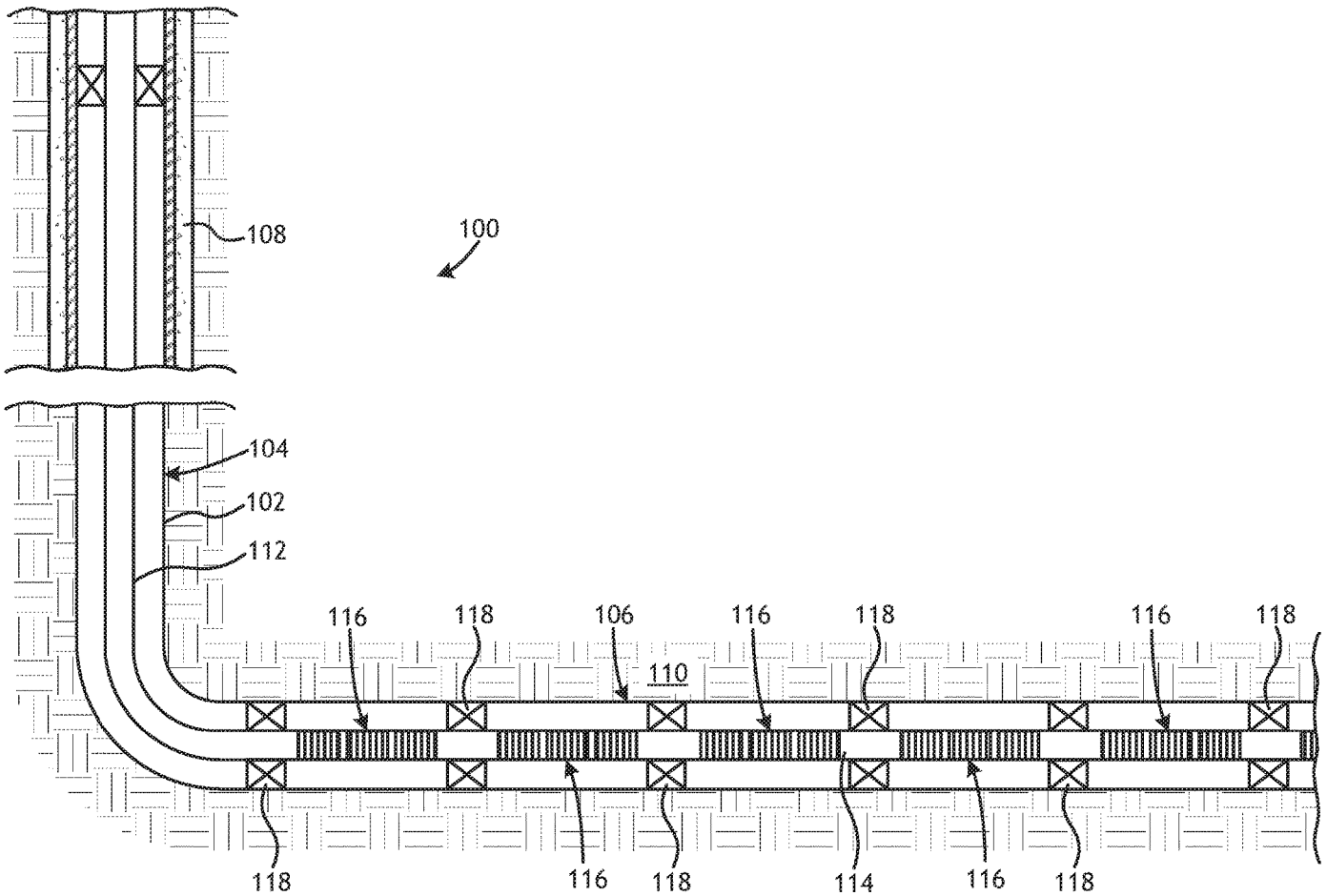
FIG. 1 is a well system that may employ the principles of the present disclosure.

FIG. 1 is a well system 100 that may employ the principles of the present disclosure, according to one or more embodiments of the disclosure. As depicted, the well system 100 includes a wellbore 102 that extends through various earth strata and has a substantially vertical section 104 that extends into a substantially horizontal section 106. The upper portion of the vertical section 104 may have a string of casing 108 cemented therein to support the wellbore 102, and the horizontal section 106 may extend through one or more hydrocarbon bearing subterranean formations 110. In at least one embodiment, as illustrated, the horizontal section 106 may be arranged within or otherwise extend through an open hole section of the wellbore 102. In other embodiments, however, the casing 108 may also extend into the horizontal section 106, without departing from the scope of the disclosure.

A tubing string 112 may be positioned within the wellbore 102 and extend from a surface location (not shown), such as the Earth's surface. The tubing string 112 provides a conduit for fluids extracted from the formation 110 to travel to the surface for production. A completion string 114 may be included at lower end of the tubing string 112 and arranged within the horizontal section 106. The completion string 114 serves to divide a completion interval into various production intervals adjacent the subterranean formation 110. As depicted, the completion string 114 may include a plurality of sand control screen assemblies 116 axially offset from each other along portions of the completion string 114. Each screen assembly 116 may be positioned between a pair of wellbore packers 118 that provides a fluid seal between the completion string 114 and the inner walls of the wellbore 102, and thereby defining discrete production intervals. In operation, each screen assembly 116 serves the primary function of filtering particulate matter out of the production fluid stream originating from the formation 110 such that particulates and other fines are not produced to the surface.

It should be noted that even though FIG. 1 depicts the screen assemblies 116 as being arranged in an open hole portion of the wellbore 102, embodiments are contemplated herein where one or more of the screen assemblies 116 is arranged within cased portions of the wellbore 102. Also, even though FIG. 1 depicts a single screen assembly 116 arranged in each production interval, any number of screen assemblies 116 may be deployed within a particular production interval without departing from the scope of the disclosure. In addition, even though FIG. 1 depicts multiple production intervals separated by the wellbore packers 118, the completion interval may include any number of production intervals with a corresponding number of wellbore packers 118 arranged therein. In other embodiments, the wellbore packers 118 may be entirely omitted from the completion interval, without departing from the scope of the disclosure.

While FIG. 1 depicts the screen assemblies 116 as being arranged in a generally horizontal section 106 of the wellbore 102, those skilled in the art will readily recognize that the screen assemblies 116 are equally well suited for use in wells having other directional configurations including vertical wells, deviated wellbores, slanted wells, multilateral wells, combinations thereof, and the like. The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
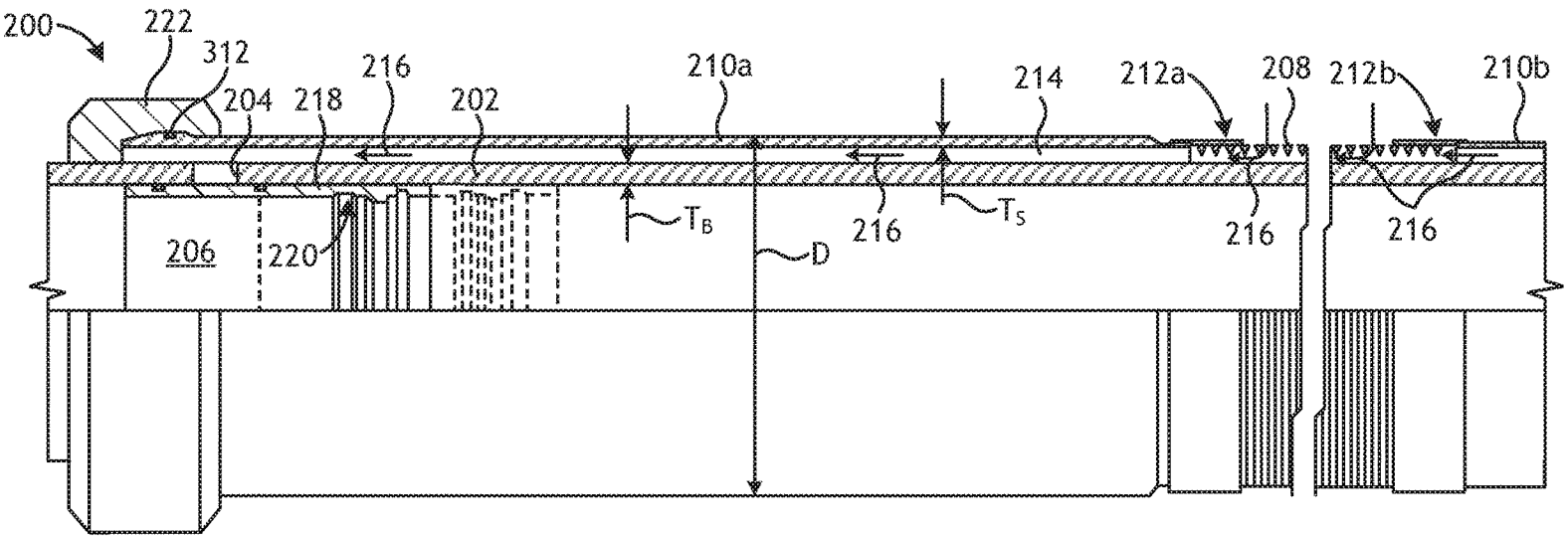
FIG. 2 is a cross-sectional side view of an exemplary sand control screen assembly.

FIG. 2 is a cross-sectional side view of an exemplary sand control screen assembly 200, according to one or more embodiments. The sand control screen assembly 200 (hereafter "the assembly 200") may replace one or more of the screen assemblies 116 described in FIG. 1 and may otherwise be used in the exemplary well system 100 depicted therein. Moreover, the assembly 200 may be characterized as a modular screen assembly, as described below. As illustrated, the assembly 200 may include or may otherwise be arranged about a base pipe 202 that defines one or more openings or flow ports 204 configured to provide fluid communication between an interior 206 of the base pipe 202 and the surrounding formation 110 (FIG. 1). At its uphole end (i.e., to the left in FIG. 2), the base pipe 202 may be operatively coupled to the tubing string 112 (FIG. 1) such that fluids flowing into the interior 206 from the surrounding formation 110 may be conveyed into the tubing string 112 and subsequently to the surface location for production.

The assembly 200 further includes one or more sand screens 208 disposed about the exterior of the base pipe 202. Each sand screen 208 serves as a filter medium designed to allow fluids to flow therethrough but generally prevent the influx of particulate matter of a predetermined size. In some embodiments, the sand screens 208 may be made from of a plurality of layers of a wire mesh that are diffusion bonded or sintered together to form a fluid porous wire mesh screen. In other embodiments, however, the sand screens 208 may have multiple layers of a weave mesh wire material having a uniform pore structure and a controlled pore size that is determined based upon the properties of the formation 110 (FIG. 1). For example, suitable weave mesh screens include, but are not limited to, a plain Dutch weave, a twilled Dutch weave, a reverse Dutch weave, combinations thereof, or the like. In other embodiments, however, the sand screens 208 may include a single layer of wire mesh, multiple layers of wire mesh that are not bonded together, a single layer of wire wrap, multiple layers of wire wrap or the like, that may or may not operate with a drainage layer. Those skilled in the art will readily recognize that several other mesh designs are equally suitable, without departing from the scope of the disclosure.

In the illustrated embodiment, the sand screen(s) 208 is depicted as being coupled to an upper annular flow ring 210*a* and a lower annular flow ring 210*b*, each being disposed about the exterior of the base pipe 202. In some embodiments, the sand screen(s) 208 may be welded to one or both of the upper and lower annular flow rings 210*a,b*, such as at upper and lower end rings 212*a* and 212*b*, respectively. In other embodiments, however, the sand screen(s) 208 may be mechanically fastened to one or both of the upper and lower annular flow rings 210*a,b* at the upper and lower end rings 212*a,b*, respectively, without departing from the scope of the disclosure.

As illustrated, the sand screen(s) 208 and the upper and lower annular flow rings 210*a,b* may be radially offset a short distance from the base pipe 202 and thereby define a flow annulus 214 therebetween. The flow annulus 214 may extend along all or a portion of the assembly 200 on the exterior of the base pipe 202. In exemplary operation of the assembly 200, a fluid may be drawn radially into the flow annulus 214 through the sand screen(s) 208, as shown by the arrows 216. The fluid 216 may originate, for example, from a surrounding subterranean formation 110 (FIG. 1). In some cases, the fluid 216 flowing through the sand screen(s) 208 shown in FIG. 2 may be combined with fluid 216 already present and flowing within the flow annulus 214 after having passed through other sand screens (not shown) located downhole (i.e., to the right in FIG. 2) from the sand screen(s) 208. Once in the flow annulus 214, the fluid 216 may flow axially along the exterior of the base pipe 202 until locating the flow ports 204 and entering the interior 206 via the flow ports 204.

The assembly 200 may further include a valve 218 positioned at or near the flow ports 204 and configured to regulate the flow of the fluid 216 through the flow ports 204 and into the interior 206. The valve 218 may be movable between a closed position, where the valve 218 occludes the flow ports 204 and otherwise prevents fluid communication between the flow annulus 214 and the interior 206, and an open position, where the valve 218 is moved or otherwise actuated to allow fluid communication between the flow annulus 214 and the interior 206. The valve 218 may comprise any device or mechanism capable of regulating the flow of the fluid 216 through the flow ports 204 and into the interior 206. Suitable devices or mechanisms that may be used as the valve 218 include, but are not limited to, a sliding side door (SSD), a sliding sleeve, a hydraulic valve disposed in or adjacent the flow ports 204, an inflow control device disposed in the flow ports 204 or the flow annulus 214, an interval control valve, . . . , and any combination thereof.

In the illustrated embodiment, the valve 218 is depicted as a sliding sleeve that defines an inner profile 220 configured to receive and mate with a corresponding outer profile of a shifting tool (not shown) or the like. Once the outer profile of the shifting tool properly locates and lands on the inner profile 220, the sliding sleeve may be moved to the open position (shown in dashed lines), such as through an axial downhole load being applied to the sliding sleeve. The shifting tool may also be used to move the sliding sleeve back to the closed position, if desired.

In some cases, the assembly 200 may include a completion end ring 222 coupled to the uphole end of the upper annular flow ring 210*a*. The completion end ring 222 may also be coupled (e.g., threaded) to the base pipe 202 to effectively terminate the flow annulus 214 and thereby force the fluid 216 flowing within the flow annulus 214 to flow into the interior 206 of the base pipe 202 via the flow port(s) 204. In other embodiments, as discussed below, the completion end ring 222 may be replaced with an outer shroud (not shown) coupled to the upper annular flow ring 210*a* and extending axially along the base pipe 202 to effectively extend the axial length of the flow annulus 214. In such embodiments, the flow port(s) 204 may be located further uphole where the flow annulus 214 eventually terminates.

While the upper and lower annular flow rings 210*a,b* may potentially be similar in structure and function, only the upper annular flow ring 210*a* (hereinafter referred to as "the annular flow ring 210*a*") will be discussed. The annular flow ring 210*a* comprises an elongate pipe or tubing that can be made of a variety of rigid materials, such as metals, plastics, composite materials, and the like. During downhole use, the annular flow ring 210*a* can be subjected to extreme pressures that could either cause the annular flow ring 210*a* to radially collapse toward the outer surface of the base pipe 202 or burst radially outward. For example, if the sand screen(s) 208 become plugged, the external pressure on the assembly 200 can increase dramatically. Increasing the external pressure can force the annular flow ring 210*a* to collapse radially inward.

The collapse rating for the annular flow ring 210*a* is equal to the ratio between its outer diameter D and the thickness $T_s$ of its annular wall. The larger the ratio of outer diameter D to thickness T ($D/T_s$), the more prone the annular flow ring 210*a* will be to an elastic collapse failure mode. If the annular flow ring 210*a* collapses radially inward under pressure, the flow annulus 214 may be substantially obstructed, and thereby impede the flow of the fluid 216 into the interior 206 of the base pipe 202.

Attempts have been made to increase the collapse rating of the annular flow ring 210*a* by upgrading the material of the annular flow ring 210*a* to a more robust (stronger) material. Upgrading the material may increase the burst rating for the annular flow ring 210*a*, but material changes have little effect on its collapse rating, once the $D/T_s$ is greater than about 25. Another method to increase the collapse rating of the annular flow ring 210*a* is to increase the wall thickness $T_s$ of the annular flow ring 210*a*. Increasing the wall thickness $T_s$, however, may correspondingly decrease the flow area of the flow annulus 214, and thereby restrict the flow of the fluid 216 into the interior 206 of the base pipe 202.

It has been found that an effective way to increase the collapse rating of the annular flow ring 210*a* in modular screen assemblies (i.e., the assembly 200), without suffering from the aforementioned drawbacks, is to radially support the annular flow ring 210*a* with the base pipe 202. The base pipe 202 typically exhibits a wall thickness $T_b$ that is larger than the thickness $T_s$ of the annular flow ring 210*a* and, therefore, is less prone to collapse. As a result, suitable structures may be included in the assembly 200 to interpose the annular flow ring 210*a* and the outer surface of the base pipe 202 and thereby radially support the annular flow ring 210*a* against collapse during operation.

Figure 3:
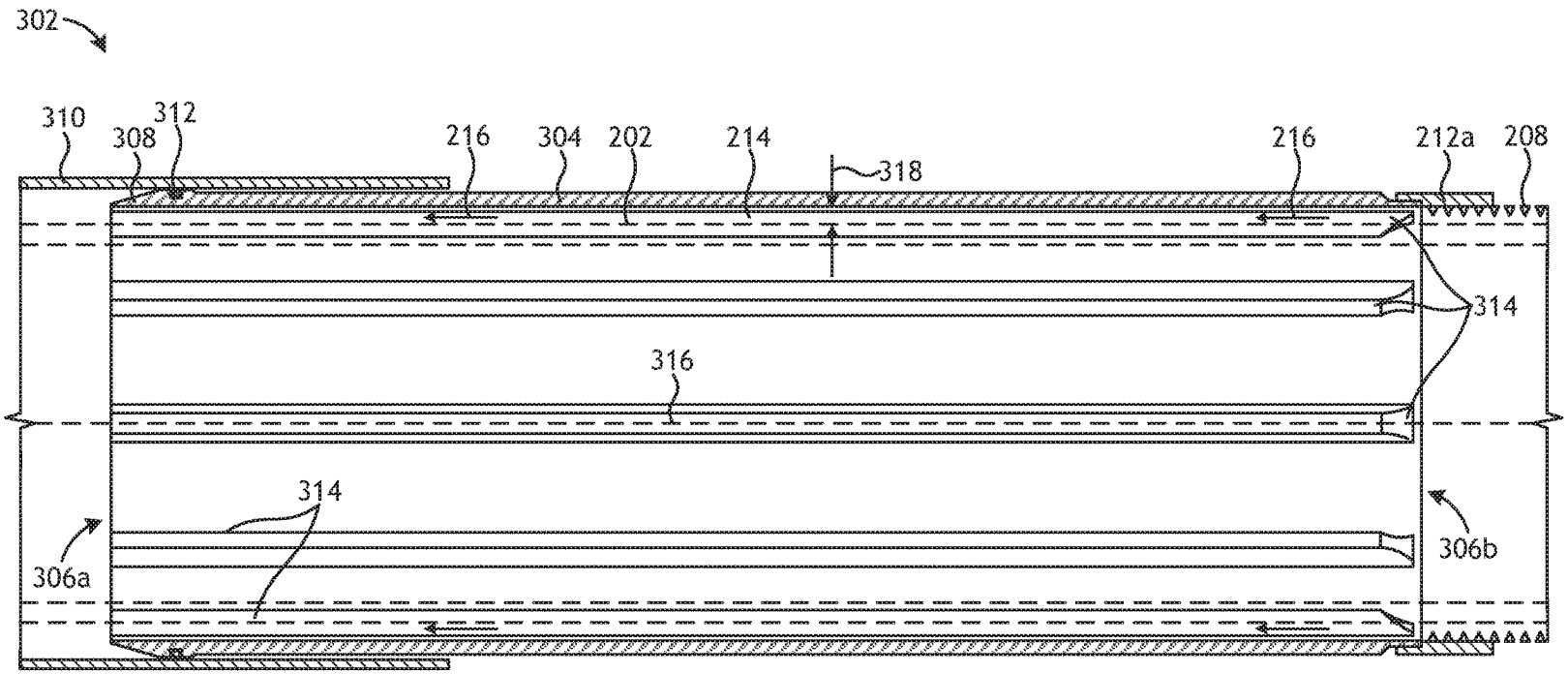
FIG. 3 is a cross-sectional side view of an exemplary annular flow ring.

FIG. 3 is a cross-sectional side view of an exemplary annular flow ring 302. The annular flow ring 302 may be the same as or similar to the annular flow ring 210*a* of FIG. 2 and therefore may be best understood with reference thereto, where like numerals refer to like components or structures. As illustrated, the annular flow ring 302 may extend about the outer diameter of the base pipe 202 (shown in dashed lines) and the flow annulus 214 may be defined therebetween. The annular flow ring 302 may comprise an elongate tubular body 304 having a first end 306*a* and a second end 306*b* opposite the first end 306*a*.

As illustrated, the first end 306*a* of the annular flow ring 302 may provide or otherwise define an interface ring 308. The interface ring 308 may be configured to receive or couple to another structural component of a modular screen assembly (e.g., the assembly 200 of FIG. 2). In some embodiments, for example, an outer shroud 310 may be configured to be coupled to (e.g., threaded, mechanically fastened, welded, etc. the annular flow ring 304 at the interface ring 308. The outer shroud 310 may provide a structural transition to an axially adjacent component of a modular screen assembly. In such embodiments, the outer shroud 310 may help extend the axial length of the flow annulus 214 along the length of the base pipe 202. In other embodiments, however, the outer shroud 310 may be replaced with a completion end ring, such as the completion end ring 222 of FIG. 2.

In at least one embodiment, a sealing element 312 may be included with the interface ring 308 and configured to sealingly engage an inner surface of the outer shroud 310 or another structural component of a modular screen assembly (i.e., the completion end ring 222 of FIG. 2). In other embodiments, the sealing element 312 may alternatively be carried on the outer shroud 310 or the other structural component. In embodiments that include the outer shroud 310, as illustrated, the sealing element 312 may provide a sealed interface that allows the flow annulus 214 to extend along the length of the base pipe 202. In embodiments that include the completion end ring 222, as shown in FIG. 2, the sealing element 312 may seal against the inner surface of the completion end ring 222 to provide a termination to the flow annulus 214.

The sealing element 312 may be made of a variety of materials including, but not limited to, an elastomeric material, rubber, a metal, a composite, a ceramic, any derivative thereof, and any combination thereof. In some embodiments, as illustrated, the sealing element 312 may comprise an O-ring positioned within a corresponding annular groove defined in the interface ring 308. In other embodiments, however, the sealing element 312 may comprise a set of v-rings or CHEVRON® packing rings, or another appropriate seal configuration (e.g., seals that are round, v-shaped, u-shaped, square, oval, t-shaped, etc.), as generally known to those skilled in the art. The sealing element 312 may alternatively comprise a molded rubber or elastomeric seal, a metal-to-metal seal (e.g., O-ring, crush ring, crevice ring, up stop piston type, down stop piston type, etc.), an interference or "close" fit, or any combination of the foregoing.

The second end 306*b* of the annular flow ring 302 may be operatively or directly coupled to the sand screen(s) 208. In some embodiments, for instance, the end ring 212*a* may be coupled (e.g., threaded, mechanically fastened, welded, etc.) to the second end 306*b* of the annular flow ring 302, and the sand screen(s) 208 may be welded or otherwise attached to the end ring 212*a* and extend axially therefrom along a portion of the axial length of the base pipe 202. The flow annulus 214 may be defined between the sand screen(s) 208 and the outer surface of the base pipe 202, as described above.

To increase the collapse rating of the annular flow ring 302, a plurality of longitudinally-extending ribs 314 are provided and otherwise defined on the inner wall (inner radial surface) of the body 304. In some embodiments, the ribs 314 can be machined into the inner wall of the body 304. In other embodiments, the ribs 314 may be cast into the inner wall of the body 304 while fabricating the annular flow ring 302.

As illustrated, the ribs 314 extend axially along the length of annular flow ring 302 and are generally parallel with a longitudinal axis 316 of the annular flow ring 302. Each rib 314 extends radially inward from the inner wall of the body 304 and may be configured to engage or come into close contact with the outer surface of the base pipe 202 when properly installed. As the ribs 314 engage the outer surface of the base pipe 202, the body 304 of the annular flow ring 302 becomes radially supported against collapse about its entire circumference. Moreover, the ribs 314 extend radially inward from the inner wall of the body 304 to a predetermined depth that results in a radial offset 318 between the annular flow ring 302 and the base pipe 202. The radial offset 318 helps define the flow annulus 214 and is large enough to generally allow unrestricted flow of the fluid 216 within the flow annulus 214 along the outer surface of the base pipe 202.

Figure 4A:
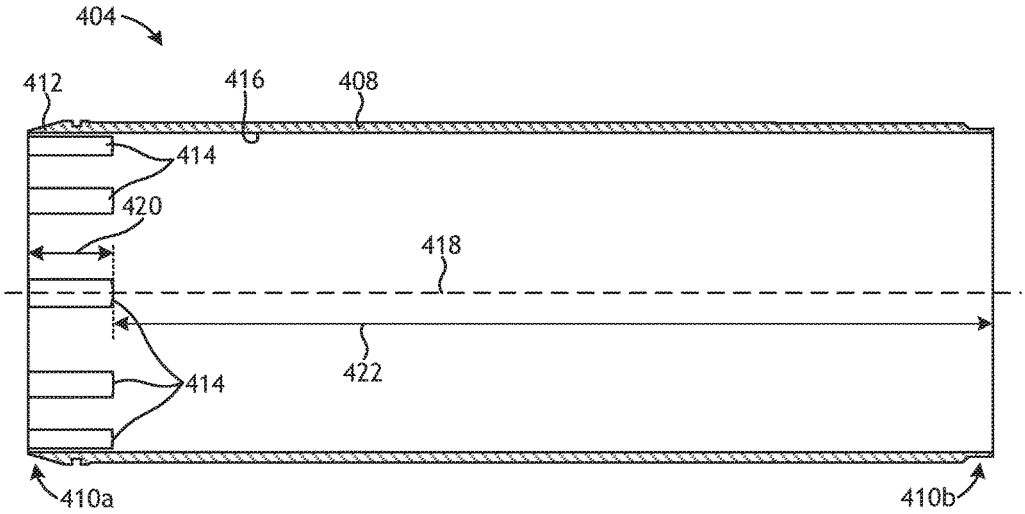
FIG. 4A is a cross-sectional side view of an outer sleeve of an exemplary annular flow ring.
Figure 4B:
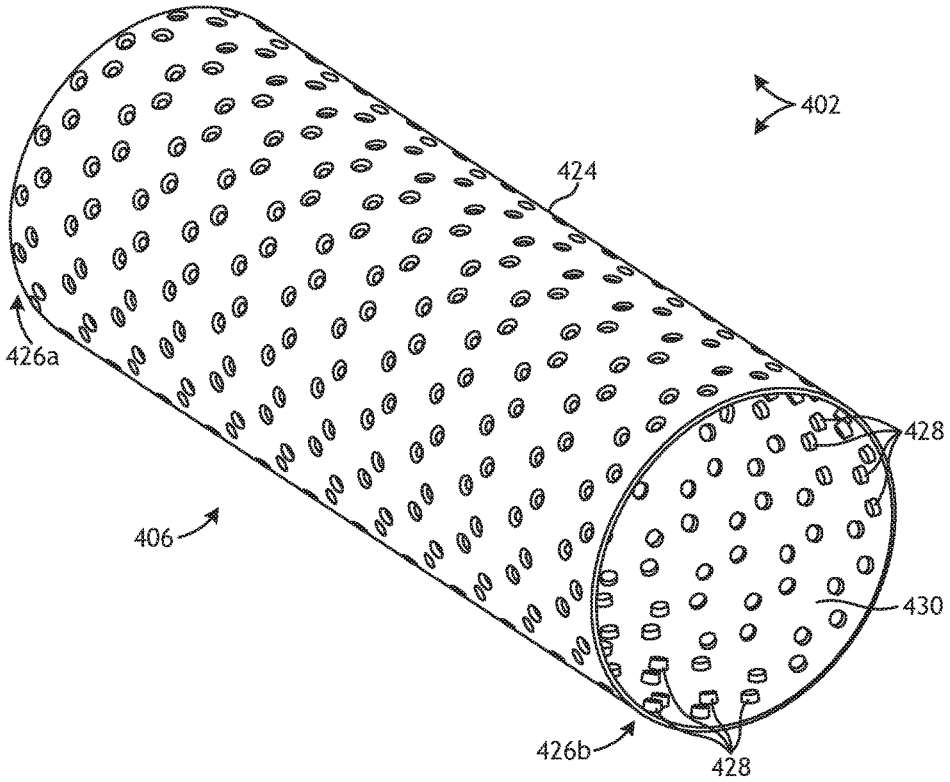
FIG. 4B is an isometric view of an inner sleeve of the annular flow ring.

FIGS. 4A and 4B are views of matable component parts of another exemplary annular flow ring 402, according to one or more embodiments of the present disclosure. More specifically, FIG. 4A is a cross-sectional side view of an outer sleeve 404 of the annular flow ring 402, and FIG. 4B is an isometric view of an inner sleeve 406 configured to be received within the outer sleeve 404. Both the outer and inner sleeves 404, 406 may be made of a variety of rigid materials including, but not limited to, metals, plastics, composite materials, and any combination thereof.

The outer sleeve 404 may comprise an elongate cylindrical body 408 having a first end 410*a* and a second end 410*b* opposite the first end 410*a*. Similar to the body 304 of the annular flow ring 302 of FIG. 3, the first end 410*a* of the body 408 may provide or otherwise define an interface ring 412. Moreover, similar to the interface ring 308 of FIG. 3, the interface ring 412 of the outer sleeve 404 may be configured to receive or couple to another structural component of a modular screen assembly (e.g., the assembly 200 of FIG. 2), as described below.

In some embodiments, the outer sleeve 404 may further include a plurality of radial projections 414 provided and otherwise defined on an inner wall 416 (i.e., the inner radial surface or diameter) of the body 408 at or near the first end 410*a*. Each radial projection 414 extends radially inward from the inner wall 416 and may be configured to engage or come into close contact with the outer surface of the base pipe 202 (FIG. 5) when properly installed about the base pipe 202. The radial projections 414 can provide a location where the outer sleeve 404 may be coupled (e.g., mechanically fastened, welded, adhered, etc.) to the base pipe 202 when the annular flow ring 402 is properly installed in a modular screen assembly (e.g., the assembly 200 of FIG. 2).

In the illustrated embodiment, the radial projections 414 are in the form of longitudinally extending ribs that extend axially and generally parallel with a longitudinal axis 418 of the outer sleeve 404. Similar to the ribs 314 of FIG. 3, the radial projections 414 depicted in FIG. 4A can be machined into the inner wall 416 of the body 304 or otherwise cast during fabrication of the outer sleeve 404. Unlike the ribs 314 of FIG. 3, however, the radial projections 414 of FIG. 4A extend only a short axial distance 420 between the first and second ends 410*a,b*. The remaining axial length 422 of the inner wall 416 of the body 408 may be smooth and thereby configured to receive the inner sleeve 406 (FIG. 4B) within the outer sleeve 404.

In some embodiments, the radial projections 414 may be equidistantly spaced from each other on the inner wall 416. In other embodiments, however, the radial projections 414 may be randomly spaced from each other, without departing from the scope of the disclosure. Moreover, while depicted in FIG. 4A as longitudinally extending ribs, the radial projections 414. may alternatively comprise any shape, size, or configuration. In some embodiments, for example, the radial projections 414 may comprise a plurality of indentations, protrusions, depressions, dimples, etc. having any polygonal, ovular, or circular shape, or any combination thereof. In other embodiments, the radial projections 414 may comprise a plurality of components or parts that can be coupled (e.g., mechanically fastened, welded, adhered, etc.) to the inner wall of the outer sleeve 404 and extend radially inward therefrom. In yet other embodiments, the radial projections 414 may be omitted altogether from the outer sleeve 404, without departing from the scope of the disclosure.

As shown in FIG. 4B, the inner sleeve 406 comprises an elongate cylindrical body 424 having a first end 426*a* and a second end 426*b* opposite the first end 426*a*. The inner sleeve 406 may be formed or otherwise manufactured via a variety of manufacturing techniques. In some embodiments, for example, the inner sleeve 406 may be cast. In other embodiments, the inner sleeve 406 may be drawn into its cylindrical or tubular shape. In yet other embodiments, the body 424 may be formed from a flat sheet of select material, such as metal, plastic, a composite material, etc., and then rolled into the form of a tube or cylinder. Once rolled, the material may then be secured in the cylindrical shape via a variety of means, such as by welding the material along a longitudinal seam, using adhesives to couple the opposing longitudinal sides, by using one or more mechanical fasteners (e.g., bolts, screws, pins, etc.), or any combination thereof. In at least one embodiment, one or more rings (not shown) may be extended about the circumference of the rolled material to retain the material in the cylindrical shape.

As indicated above, the inner sleeve 406 is configured to be received within the outer sleeve 404 to form the assembled annular flow ring 402. More specifically, the inner sleeve 406 may be extended into the interior of the outer sleeve 404 from the second end 410*b* of the outer sleeve 404 and advanced toward the first end 410*a* until the first end 426*a* of the inner sleeve 406 engages or comes into close contact with the radial projections 414. In some embodiments, however, the inner sleeve 406 may alternatively be advanced within the outer sleeve 404 to any location between the first and second ends 410*a,b* of the outer sleeve 404 and otherwise to any point along the remaining axial length 422, without departing from the scope of the disclosure.

The inner sleeve 406 may be coupled or otherwise secured to the outer sleeve 404 via a variety of coupling means. In some embodiments, for example, the inner sleeve 406 may be secured within the outer sleeve 404 via an interference fit. More specifically, the outer sleeve 404 may be heated to increase its diameter, and the inner sleeve 406 may be extended into the interior of the outer sleeve 404 while the outer sleeve 404 is held at an elevated temperature. Once the outer sleeve 404 cools, an interference fit between the outer and inner sleeves 404, 406 will result as the outer sleeve 404 shrinks back to its room temperature diameter. In other embodiments, however, the inner sleeve 406 may be coupled to the outer sleeve 404 using other coupling means including, but not limited to, mechanical fasteners (e.g., screws, bolts, pins, snap rings, etc.), welding, brazing, industrial adhesives, or any combination thereof. In yet other embodiments, the outer sleeve 404 could be mechanically deformed at one or both of its end to retain the inner sleeve 406.

Figure 5:
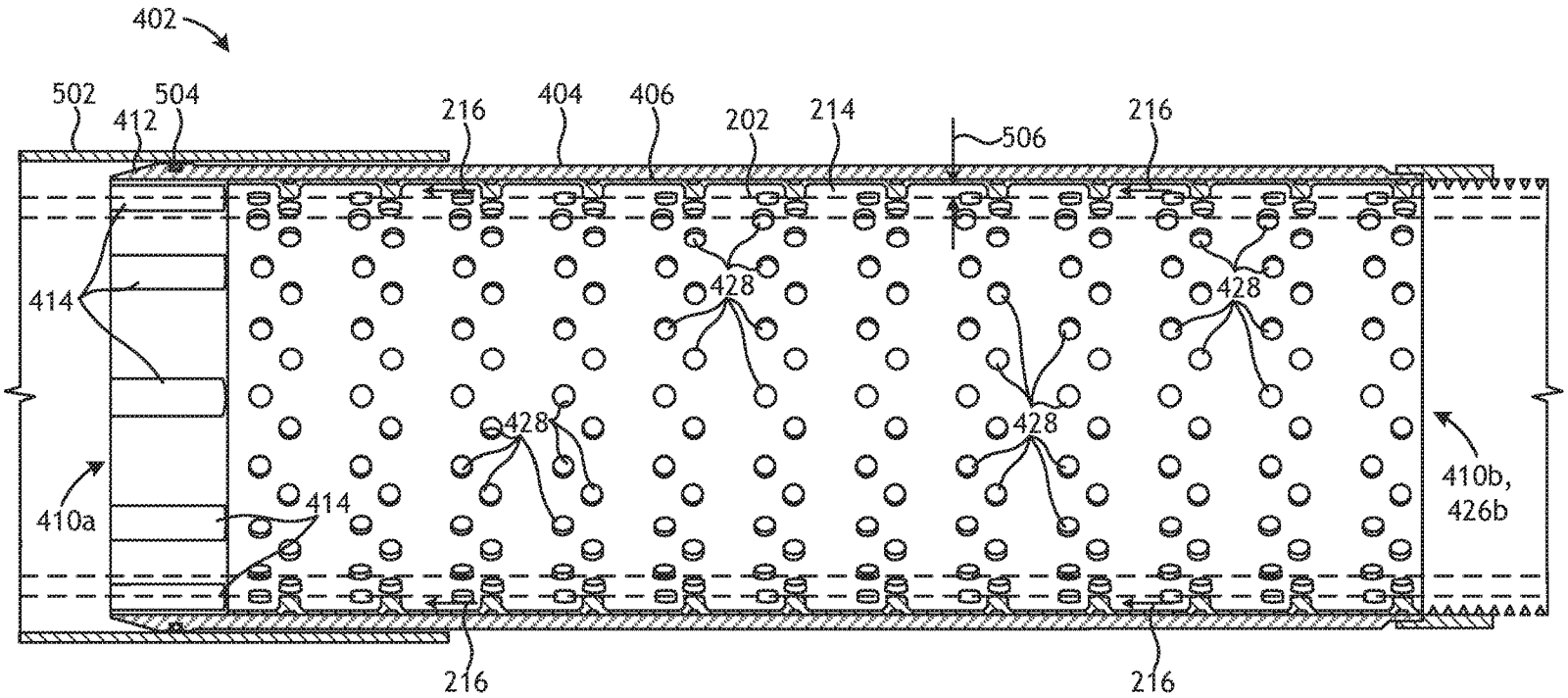
FIG. 5 is a cross-sectional side view of the assembled annular flow ring of FIGS. 4A and 4B.

As illustrated, the inner sleeve 406 may include a plurality of radial projections 428 provided or otherwise defined on an inner wall 430 (i.e., the inner radial surface or diameter) of the body 424. Each radial projection 428 extends radially inward from the inner wall 430 and may be configured to engage or come into close contact with the outer surface of the base pipe 202 (FIG. 5) when the annular flow ring 402 is properly installed about the base pipe 202. One or more of the radial projections 428 may extend inward to a radial depth or height equal to or close to the radial depth or height of the radial projections 414 of the outer sleeve 404. As a result, radial projections 414, 428 of each sleeve 404, 406, respectively, may cooperatively provide radial support for the assembled annular flow ring 402 during operation. In at least one embodiment, one or more of the radial projections 428 may exhibit a radial depth or height different than other radial projections 428 to thereby create an eccentric flow annulus 214 (FIGS. 2 and 5).

In the illustrated embodiment, the radial projections 428 are in the form of depressions or dimples mechanically formed into the body 424, such as by using a mechanical punch or die that plastically deforms the body 424. While depicted in FIG. 4B as circular depressions or dimples, the radial projections 428 may alternatively comprise any shape or form. In some embodiments, for example, the radial projections 428 may exhibit any polygonal, ovular, or circular shape, or any combination thereof. In other embodiments, the radial projections 428 may comprise a plurality of parts or components configured to be coupled to the inner wall 430 of the inner sleeve 406 and extend radially inward therefrom. In at least one embodiment, for instance, one or more of the radial projections 428 may comprise a rod-like member, such as a bolt, a screw, a rod, or a pipe that may be mechanically fastened (e.g., threaded), welded, or adhered to the inner wall 430 of the inner sleeve 406 and extend radially inward therefrom.

Moreover, the size of each radial projection 428 may vary, depending on the application. Since the radial projections 428 extend into the flow annulus 214 (FIGS. 2 and 5), increasing the size and number of radial projections 428 may restrict fluid flow along the outer surface of the base pipe 202 (FIG. 5). Conversely, decreasing the size and number of the radial projections 428 will allow fluid to flow more freely along the outer surface of the base pipe 202. Moreover, while depicted in FIG. 4B as exhibiting a single size, the radial projections 428 may alternatively exhibit varying sizes.

The radial projections 428 may also be provided on the inner wall 430 in any pattern or configuration. While shown in FIG. 4B as being arranged in radial bands or clusters, the radial projections 428 may alternatively be spaced evenly or equidistantly from each other on the inner wall 430. In other embodiments, however, some or all of the radial projections 428 may be randomly spaced from each other, without departing from the scope of the disclosure.

FIG. 5 is a cross-sectional side view of the assembled annular flow ring 402 of FIGS. 4A and 4B. The annular flow ring 402 may be the same as or similar to the annular flow ring 210*a* of FIG. 2 and therefore may form part of the assembly 200 shown in FIG. 2. Accordingly, the assembled annular flow ring 402 may be best understood with reference to the assembly 200, where like numerals refer to like components or structures. In the assembled configuration, the inner sleeve 406 of the annular flow ring 402 is extended within and otherwise received by the outer sleeve 404. The assembled annular flow ring 402 may then be arranged to extend about the outer diameter of the base pipe 202 (shown in dashed lines), thereby resulting in the formation of the flow annulus 214 therebetween.

As discussed above, the first end 410*a* of the outer sleeve 404 may provide the interface ring 412, which may be configured to receive or couple to another structural component of a modular screen assembly. In the illustrated embodiment, the interface ring 412 is depicted as being coupled to an outer shroud 502, which may be similar to the outer shroud 310 of FIG. 3. In other embodiments, however, the outer shroud 502 may be replaced with a completion end ring, such as the completion end ring 222 of FIG. 2. Moreover, a sealing element 504 may be included with the interface ring 412 to sealingly engage an inner surface of the outer shroud 502 or the completion end ring 222. The sealing element 504 may be similar to the sealing element 312 of FIG. 3 and, therefore, will not be described again.

Similar to the annular flow ring 302 of FIG. 3, the second end 410*b* of the outer sleeve 404 of the annular flow ring 402 may be operatively or directly coupled to the sand screen(s) 208, such as at the end ring 212*a* as described above.

The radial projections 414 of the outer sleeve 404 (if included) and the radial projections 428 provided by the inner sleeve 406 may individually or cooperatively help increase the collapse rating of the annular flow ring 402. More specifically, the radial projections 414, 428 extend radially inward to engage or come into close contact with the outer surface of the base pipe 202 when installed. As the radial projections 414, 428 engage the outer surface of the base pipe 202 during operation, the outer and inner sleeves 404, 406 of the annular flow ring 402 become radially supported against collapse about their entire circumference.

The radial projections 414, 428 extend radially inward to a predetermined depth that results in a radial offset 506 between the annular flow ring 402 and the base pipe 202. The radial offset 506 helps define the flow annulus 214 and is large enough to generally allow unrestricted flow of the fluid 216 within the flow annulus 214 along the outer surface of the base pipe 202. During production operations, the fluid 216 may circulate between and around the radial projections 414, 428 as it flows along the outer surface of the base pipe 202.

The principles discussed herein are most effective on thin-walled, large outer diameter cylindrical parts or components, such as those commonly found in the oil and gas industry. It should be noted, however, that while the foregoing discussion is directed to annular flow rings used in modular screen assemblies, the principles of the present disclosure are equally applicable to any type of tubular or pipe. For instance, the outer shrouds 310 and 502 of FIGS. 3 and 5, respectively, or cross coupling connectors may also include such features to increase their respective collapse rating.

Embodiments Disclosed Herein Include:

A. A sand control screen assembly that includes a base pipe, a sand screen positioned about an outer surface of the base pipe, an annular flow ring positioned about the outer surface of the base pipe and operatively coupled to the sand screen, the annular flow ring including a cylindrical outer sleeve, a cylindrical inner sleeve received within and coupled to the outer sleeve, and a plurality of radial projections extending radially inward from the inner sleeve to radially support the annular flow ring against the outer surface of the base pipe, and a flow annulus defined between the outer surface of the base pipe and the annular flow ring and the sand screen, wherein the plurality of radial projections extends into the flow annulus.

B. A method that includes drawing a fluid through a sand screen and into a flow annulus defined between the sand screen and an outer surface of a base pipe, flowing the fluid axially along the outer surface of the base pipe within the flow annulus and beneath an annular flow ring positioned about the base pipe and operatively coupled to the sand screen, the annular flow ring including a cylindrical outer sleeve, a cylindrical inner sleeve received within and coupled to the outer sleeve, and a plurality of radial projections extending radially inward from the inner sleeve and into the flow annulus, and radially supporting the annular flow ring against the outer surface of the base pipe with the plurality of radial projections.

C. An annular flow ring for a modular screen assembly that includes a cylindrical outer sleeve, a cylindrical inner sleeve received within and coupled to the outer sleeve, and a plurality of radial projections extending radially inward from the inner sleeve to radially support the cylindrical outer and inner sleeves against the outer surface of the base pipe.

Each of embodiments A, B, and C may have one or more of the following additional elements in any combination: Element 1: wherein at least some of the plurality of radial projections comprise a plurality of depressions plastically formed in the inner sleeve. Element 2: wherein at least some of the plurality of radial projections comprise longitudinally-extending ribs provided on an inner wall of the inner sleeve. Element 3: wherein the plurality of radial projections exhibits a shape selected from the group consisting of polygonal, ovular, circular, and any combination thereof. Element 4: further comprising a plurality of outer sleeve radial projections provided on an inner wall of the outer sleeve at or near an end of the outer sleeve. Element 5: wherein the plurality of outer sleeve radial projections comprises longitudinally extending ribs extending axially and parallel with a longitudinal axis of the outer sleeve. Element 6: wherein the plurality of outer sleeve radial projections extends radially inward to a radial depth similar to a radial depth of the plurality of radial projections. Element 7: wherein the inner sleeve is secured to the outer sleeve via at least one of an interference fit, one or more mechanical fasteners, welding, brazing, an industrial adhesive, mechanical deformation of the outer sleeve, and any combination thereof. Element 8: further comprising one or more flow ports defined in the base pipe to allow fluid communication between an interior and an exterior of the base pipe, and a valve positioned at or near the one or more flow ports and actuatable between a closed position, where fluid communication between the flow annulus and the interior is prevented, and an open position, where fluid communication between the flow annulus and the interior is allowed.

Element 9: further comprising flowing the fluid axially within the flow annulus along an exterior of the base pipe until locating one or more flow ports defined in the base pipe, and regulating flow into an interior of the base pipe from the flow annulus with a valve. Element 10: wherein a plurality of outer sleeve radial projections are provided on an inner wall of the outer sleeve at or near an end of the outer sleeve, the method further comprising radially supporting the annular flow ring against the outer surface of the base pipe with the plurality of radial projections and the plurality of outer sleeve radial projections. Element 11: further comprising coupling the annular flow ring to the base pipe at the plurality of outer sleeve radial projections.

Element 12: wherein at least some of the plurality of radial projections comprises depressions plastically formed in the inner sleeve. Element 13: wherein at least some of the plurality of radial projections comprises longitudinally-extending ribs provided on an inner wall of the inner sleeve. Element 14: wherein the plurality of radial projections exhibits a shape selected from the group consisting of polygonal, ovular, circular, and any combination thereof. Element 15: further comprising a plurality of outer sleeve radial projections provided on an inner wall of the outer sleeve at or near an end of the outer sleeve. Element 16: wherein the plurality of outer sleeve radial projections extends radially inward to a radial depth similar to a radial depth of the plurality of radial projections. Element 17: wherein the inner sleeve is secured to the outer sleeve via at least one of an interference fit, one or more mechanical fasteners, welding, brazing, an industrial adhesive, and any combination thereof.

By way of non-limiting example, exemplary combinations applicable to A, B, and C include: Element 4 with Element 5; Element 4 with Element 6; Element 10 with Element 11; and Element 15 with Element 16.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A sand control screen assembly, comprising:

a base pipe;

a sand screen positioned about an outer surface of the base pipe;

an annular flow ring positioned about the outer surface of the base pipe and operatively coupled to the sand screen, the annular flow ring including a cylindrical outer sleeve, a cylindrical inner sleeve received within and coupled to the outer sleeve, a plurality of radial projections extending radially inward from the inner sleeve, a plurality of outer sleeve radial projections provided on an inner wall of the outer sleeve at or near an end of the outer sleeve; and a flow annulus defined between the outer surface of the base pipe and the annular flow ring and the sand screen, wherein the plurality of radial projections extends into the flow annulus;

wherein the plurality of radial projections and the plurality of outer sleeve radial projections support the annular flow ring against the outer surface of the base pipe.

2. The sand control screen assembly of claim 1, wherein at least some of the plurality of radial projections comprise a plurality of depressions plastically formed in the inner sleeve.

3. The sand control screen assembly of claim 1, wherein at least some of the plurality of radial projections comprise longitudinally-extending ribs provided on an inner wall of the inner sleeve.

4. The sand control screen assembly of claim 1, wherein the plurality of radial projections exhibits a shape selected from the group consisting of polygonal, ovular, circular, and any combination thereof.

5. The sand control screen assembly of claim 1, wherein the plurality of outer sleeve radial projections comprises longitudinally extending ribs extending axially and parallel with a longitudinal axis of the outer sleeve.

6. The sand control screen assembly of claim 1, wherein the plurality of outer sleeve radial projections extends radially inward to engage or come into close contact with the outer surface of the base pipe.

7. The sand control screen assembly of claim 1, wherein the inner sleeve is secured to the outer sleeve via at least one of an interference fit, one or more mechanical fasteners, welding, brazing, an industrial adhesive, mechanical deformation of the outer sleeve, and any combination thereof.

8. The sand control screen assembly of claim 1, further comprising:

one or more flow ports defined in the base pipe to allow fluid communication between an interior and an exterior of the base pipe; and a valve positioned at or near the one or more flow ports and actuatable between a closed position, where fluid communication between the flow annulus and the interior is prevented, and an open position, where fluid communication between the flow annulus and the interior is allowed.

9. A method, comprising:

drawing a fluid through a sand screen and into a flow annulus defined between the sand screen and an outer surface of a base pipe;

flowing the fluid axially along the outer surface of the base pipe within the flow annulus and beneath an annular flow ring positioned about the base pipe and operatively coupled to the sand screen, the annular flow ring including a cylindrical outer sleeve, a cylindrical inner sleeve received within and coupled to the outer sleeve, and a plurality of radial projections extending radially inward from the inner sleeve and into the flow annulus; and radially supporting the annular flow ring against the outer surface of the base pipe with the plurality of radial projections;

wherein a plurality of outer sleeve radial projections are provided on an inner wall of the outer sleeve at or near an end of the outer sleeve, the method further comprising radially supporting the annular flow ring against the outer surface of the base pipe with the plurality of radial projections and the plurality of outer sleeve radial projections.

10. The method of claim 9, further comprising:

flowing the fluid axially within the flow annulus along an exterior of the base pipe until locating one or more flow ports defined in the base pipe; and regulating flow into an interior of the base pipe from the flow annulus with a valve.

11. The method of claim 9, further comprising coupling the annular flow ring to the base pipe at the plurality of outer sleeve radial projections.

12. An annular flow ring for a modular screen assembly, comprising:

a cylindrical outer sleeve;

a cylindrical inner sleeve received within and coupled to the outer sleeve; and a plurality of radial projections extending radially inward from the inner sleeve to radially support the cylindrical outer and inner sleeves against the outer surface of a base pipe;

a plurality of outer sleeve radial projections provided on an inner wall of the outer sleeve at or near an end of the outer sleeve;

wherein the plurality of radial projections and the plurality of outer sleeve radial projections support the annular flow ring against the outer surface of the base pipe.

13. The annular flow ring of claim 12, wherein at least some of the plurality of radial projections comprises depressions plastically formed in the inner sleeve.

14. The annular flow ring of claim 13, wherein the inner sleeve is secured to the outer sleeve via at least one of an interference fit, one or more mechanical fasteners, welding, brazing, an industrial adhesive, and any combination thereof.

15. The annular flow ring of claim 12, wherein at least some of the plurality of radial projections comprises longitudinally-extending ribs provided on an inner wall of the inner sleeve.

16. The annular flow ring of claim 12, wherein the plurality of radial projections exhibits a shape selected from the group consisting of polygonal, ovular, circular, and any combination thereof.

17. The annular flow ring of claim 12, wherein the plurality of outer sleeve radial projections extends radially inward to engage or come into close contact with the outer surface of the base pipe.

* * * * *